US009341002B2

(12) United States Patent
Kongshammer

(10) Patent No.: US 9,341,002 B2
(45) Date of Patent: May 17, 2016

(54) LOCKING SYSTEM AND APPLICATION

(71) Applicant: Martin Kongshammer, Kongens Lyngby (DK)

(72) Inventor: Martin Kongshammer, Kongens Lyngby (DK)

(73) Assignee: Mavako ApS, Skovlunde (DK)

( * ) Notice: Subject to any disclaimer, the term of this patent is extended or adjusted under 35 U.S.C. 154(b) by 0 days.

(21) Appl. No.: 14/437,644

(22) PCT Filed: Aug. 28, 2013

(86) PCT No.: PCT/DK2013/000054
§ 371 (c)(1),
(2) Date: Apr. 22, 2015

(87) PCT Pub. No.: WO2014/063702
PCT Pub. Date: May 1, 2014

(65) Prior Publication Data

US 2015/0292243 A1 Oct. 15, 2015

(30) Foreign Application Priority Data

Oct. 24, 2012 (DK) ..... 2012 00657

(51) Int. Cl.
*E05B 65/48* (2006.01)
*E05B 67/38* (2006.01)
(Continued)

(52) U.S. Cl.
CPC ..... *E05B 65/48* (2013.01); *E05B 65/0007* (2013.01); *E05B 67/38* (2013.01); *E05C 19/005* (2013.01); *E05C 19/08* (2013.01)

(58) Field of Classification Search
CPC . Y10T 70/498; Y10T 70/493; Y10T 70/7921; Y10T 292/31; Y10T 70/30; Y10T 70/496; Y10T 292/1049; Y10T 292/23; Y10T 70/5739; Y10T 70/7915; E05B 67/38; E05B 67/383; E05B 17/2084; E05B 83/12
USPC ..... 70/54–56, 77, 202, 203, 211, 212, 417, 70/DIG. 43, DIG. 56; 292/DIG. 32, 205, 292/218, 281.289, 297, 298
See application file for complete search history.

(56) References Cited

U.S. PATENT DOCUMENTS 3,392,555 A * 7/1968 Beaver ..... E05B 67/38 70/56
4,033,156 A * 7/1977 Cottingham ..... E05B 17/002 174/67

(Continued)

FOREIGN PATENT DOCUMENTS

| | | |
|---|---|---|
| DK | 170428 | 8/1995 |
| EP | 0 301 535 | 9/1993 |

*Primary Examiner* — Suzanne Barrett
(74) *Attorney, Agent, or Firm* — Ware, Fressola, Maguire & Barber LLP

(57) ABSTRACT

The present invention relates to a locking system (1) for locking of compartments or boxes including containers to which the access mainly consists of double doors or gates A, B, where the locking system (1) comprises a bar (2), which at one end is fitted with a primarily cylindrical shaft (3) around which the bar (2) can be rotated horizontally and which at the opposite end is fitted with an angled lock cover (12). The locking system (1) further comprises a fitting (4) that can be fitted in gate A, and which can partially enclose the cylindrical shaft (3). The locking system further comprises a fitting (11) that can be fitted in the second gate B, and which covers a lock (22) on four sides and onto which the lock cover (12) can be locked. By using this invention, e.g. containers can be locked effectively and safely.

4 Claims, 8 Drawing Sheets

(51) Int. Cl.

| | |
|---|---|
| ***E05C 19/08*** | (2006.01) |
| ***E05B 65/00*** | (2006.01) |
| ***E05C 19/00*** | (2006.01) |

(56) References Cited

U.S. PATENT DOCUMENTS

| | | | | | |
|---|---|---|---|---|---|
| 4,286,814 | A * | 9/1981 | Harrington | E05B 65/48 | 292/148 |
| 4,567,740 | A | 2/1986 | Kelly | | |
| 5,035,127 | A * | 7/1991 | Larsen | E05B 67/38 | 70/417 |
| 5,172,574 | A | 12/1992 | Perfetto | | |
| 5,799,521 | A * | 9/1998 | Kennedy | E05B 13/001 | 292/259 R |
| 6,058,745 | A * | 5/2000 | Sanchez | E05B 67/38 | 70/417 |
| 6,581,419 | B1 * | 6/2003 | Strodtman | E05B 13/002 | 292/205 |
| 7,278,284 | B1 | 10/2007 | James | | |
| 2004/0031297 | A1 * | 2/2004 | Winland | E05B 67/38 | 70/2 |
| 2005/0144991 | A1 * | 7/2005 | Bravo | E05B 13/002 | 70/56 |
| 2011/0309600 | A1 * | 12/2011 | Allsop | B60D 1/065 | 280/511 |
| 2012/0144883 | A1 | 6/2012 | Longwell | | |
| 2012/0211966 | A1 * | 8/2012 | Drake | B60D 1/06 | 280/507 |

* cited by examiner

LOCKING SYSTEM AND APPLICATION

CROSS-REFERENCE TO RELATED APPLICATIONS

This application is a U.S. national stage of International Appl. No. PCT/DK2013/000054 filed 28 Aug. 2013, which claimed priority to Danish Appl. No. PA 2012 00657 filed 24 Oct. 2012, which applications are incorporated herein by reference in their entireties.

TECHNICAL FIELD

The present invention relates to a locking system for locking of compartments or boxes including containers to which the access mainly consists of double doors or gates A, B.

Furthermore, the invention relates to the application of a locking system.

BACKGROUND

From DK170428 is known a locking system for containers with double doors A, B, where a bar is mounted in door A in a pivot joint, thus enabling the bar to swing like a pendulum, and rotate such that it becomes fixed to a locking device that is mounted to door B. The bar can be locked to the locking unit, whereby the double doors A, B become barred by the transverse bar, which then locks the container.

It has been found, however, that there are some drawbacks of this known technique, including that the bar, which can swing like a pendulum, can pose a risk if an operator loses the hold on an unlocked bar. The bar will in such case make a pendulum movement and can thus strike the operator, which can cause serious bodily injury.

It is also a problem that the locking device is not is covered by hardened steel on all sides, which makes it relatively easy to destroy the lock whereby the container can be opened easily.

SUMMARY OF THE INVENTION

It is therefore an object of the invention to provide a locking system for containers that solves the above-mentioned disadvantages and issues.

The object of the invention is achieved by a locking system for locking of compartments, boxes or containers to which the access mainly consists of double doors or a first gate and a second gate and includes a bar having one end fitted with a primarily cylindrical shaft, and an opposite end fitted with an angled lock cover, a fitting component that is adapted to be fitted in the first gate, and which partially enclose the cylindrical shaft enabling the bar to be rotated horizontally, and a fitting that is adapted to be fitted in the second gate, and which covers a lock on four sides onto which the angled lock cover is adapted to be locked.

In this way, it thus becomes possible to use the locking system for containers without the risk of the bar oscillating, which thus eliminates the risk of operators getting seriously injured.

Moreover, it is achieved that the lock is covered on all six sides when the bar's lock cover is fixed to the lock, making it very difficult and time consuming to break open the lock.

Other preferred embodiments of the locking system are also described further below.

As mentioned, the invention also relates to the use of a locking system for transport containers, which are transported by container ships, trucks and trains.

This makes it possible to effectively lock transport containers without risk of personal injury.

BRIEF DESCRIPTION OF THE DRAWINGS

The invention will now be explained more further with reference to the drawings, in which.

DETAILED DESCRIPTION OF THE INVENTION

Figure 1:
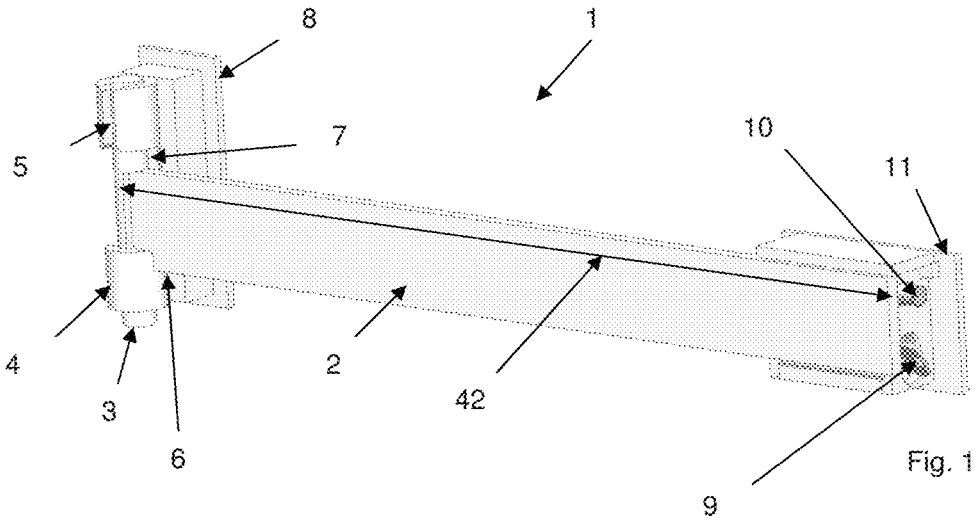
FIG. 1 shows a preferred embodiment of a locking system constructed according to the invention, where a bar can block the double doors of a container.

In FIG. 1, the number 1 shows a locking system which includes a bar 2 with a length 42, wherein the bar 2 at one end is fitted with a primarily cylindrical shaft 3.

The cylindrical shaft 3 is placed in a fitting 8 which can be fixed to door A in a pair of double doors A, B which are typically used for containers, including transport containers, whereby the bar can be rotated horizontally around the cylindrical shaft.

At the opposite end, the bar 2 locked onto a fitting 11 which can be fixed to door B of the double doors A, B.

When the bar 2, as shown in FIG. 1, is locked to the fitting 11, the locking action is performed with a lock covered by the bar 2 on two sides, and to which a key 9 can be connected, and from which an end 10 of a locking pawl 23 (see FIGS. 9 and 10) is protruding.

Figure 2:
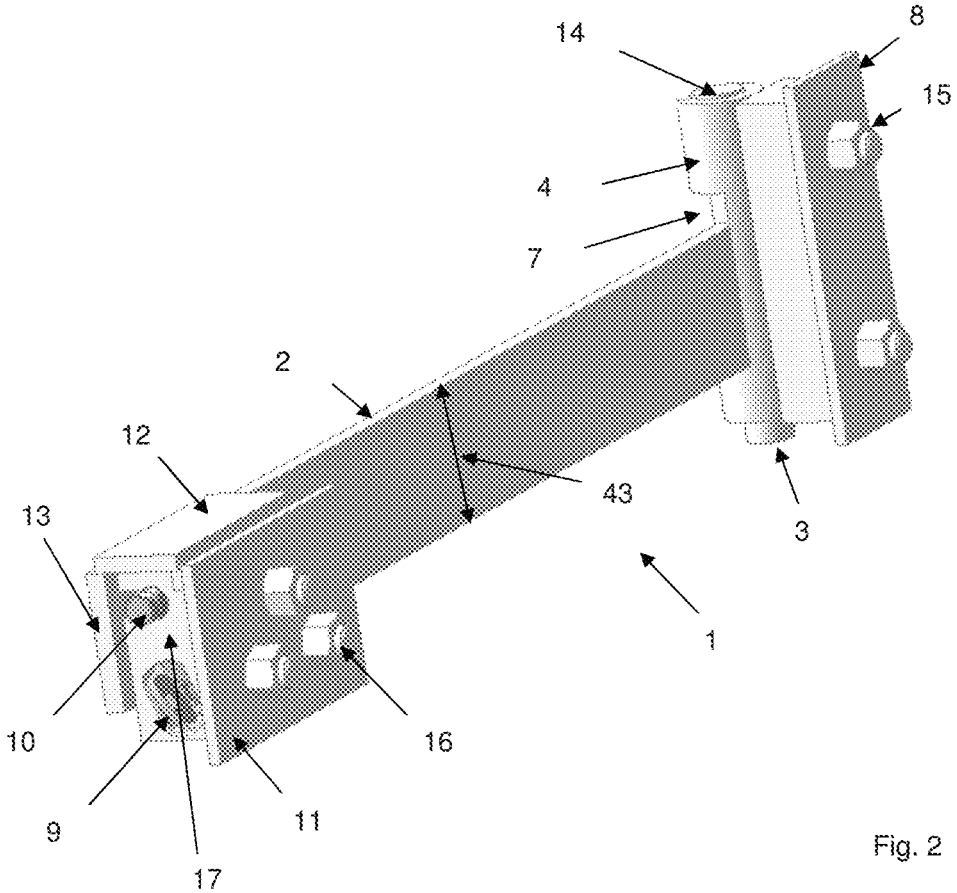
FIG. 2 shows the same locking system as FIG. 1, but shown from a second perspective.

FIG. 2 shows the locking system 1 from a different perspective than in FIG. 1 thus showing that the fitting 8 can be fixed to door A by bolts 15 just as the fitting 11 can be fixed to door B with bolts 16.

FIG. 2 also shows that the bar's 2 width is illustrated by 43 and that the bar 2 at the end facing away from the cylindrical shaft 3 is fitted with an angled lock cover 12.

As can also be seen from FIG. 2, the lock, which is enclosed by the bar's 2 end plate 13, and the lock cover 12 are also enclosed by a cover plate 17 which is part of the fitting 11, and from which the key 9 and the end 10 of the locking pawl 23 connect to the lock.

Figure 3:
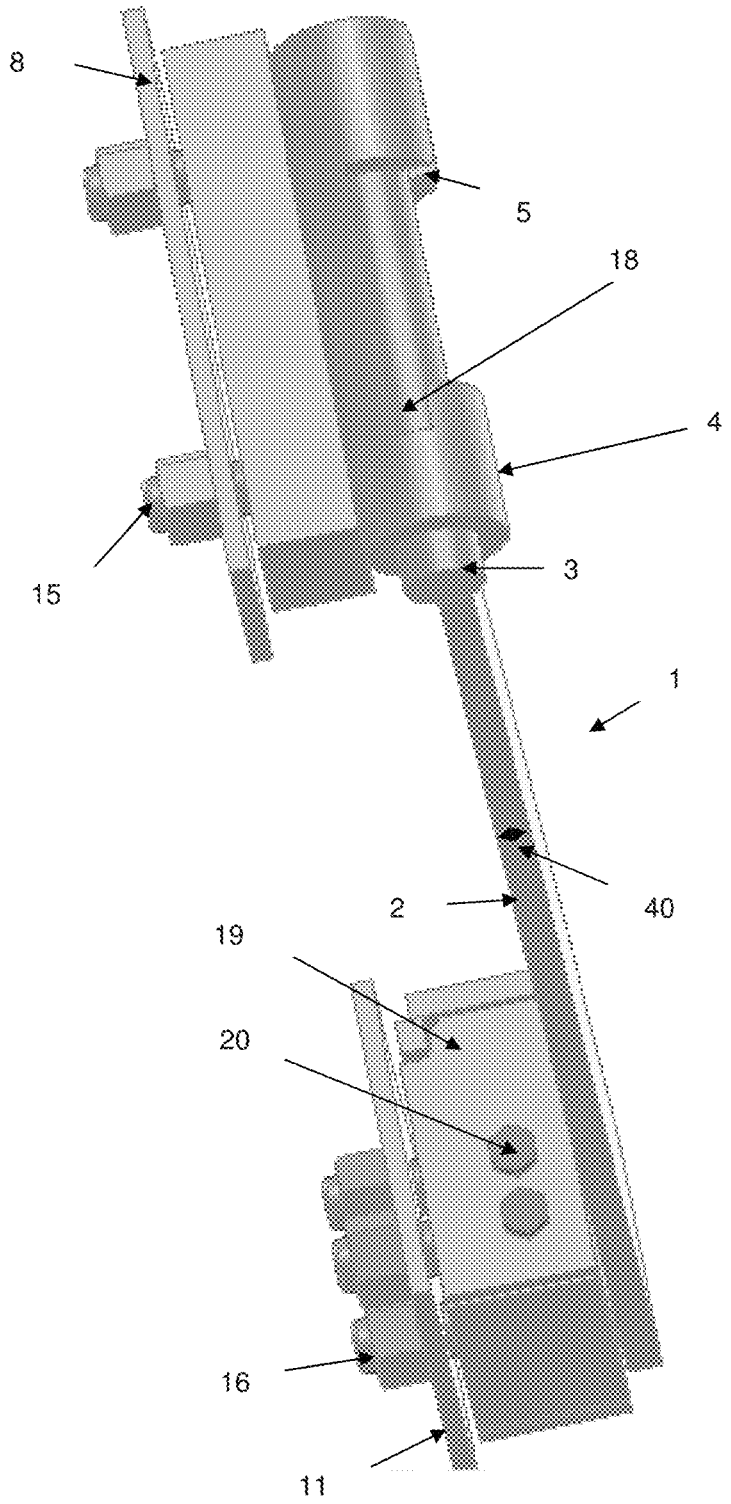
FIG. 3 shows the same locking system as FIGS. 1 and 2, but shown from a third perspective.

FIG. 3 shows the locking system 2 from a perspective showing bolts 20 which, through a cover plate 19 that forms part of the fitting 11, can fix it to the hidden lock shown in FIG. 3 which is located behind the cover plate 19.

FIG. 1 and FIG. 2 also show that the bar 2 in the shown position where the bar 2 is fixed to the fitting 11, the bottom is placed in a notch 6 in a fitting component 4, which partially encloses the bar's 2 cylindrical shaft 3, whereby the bar 2 is fixed to the fitting 8.

FIG. 1 and FIG. 2 also show that there is a clearance 7 between the bar 2 and the upper part of the fitting component 4.

The clearance 7 is greater than the depth of the notch 6, wherein the bar 2, upon release of the lock, which is located in the fitting 11, can be lifted out of the notch 6 and then rotated horizontally in the fitting component 4.

As shown in FIG. 1, the fitting component 4 contains an opening 5 at the top, which has a width that is greater than the thickness 40 of the bar 2 (see FIG. 3), whereby the bar 2 can be lifted clear of the fitting component 4 through the opening 5.

In FIG. 3, the locking system 1 is shown from a perspective which illustrates that the fitting component 4 contains a notch 18 that corresponds to the notch 6, but located at the opposite side of the fitting component 4.

The notch 18 can thus be used to secure the bar 2 in a position where it is rotated a number of degrees, primarily 180, with respect to the position where it is locked to the fitting 11.

Figure 4:
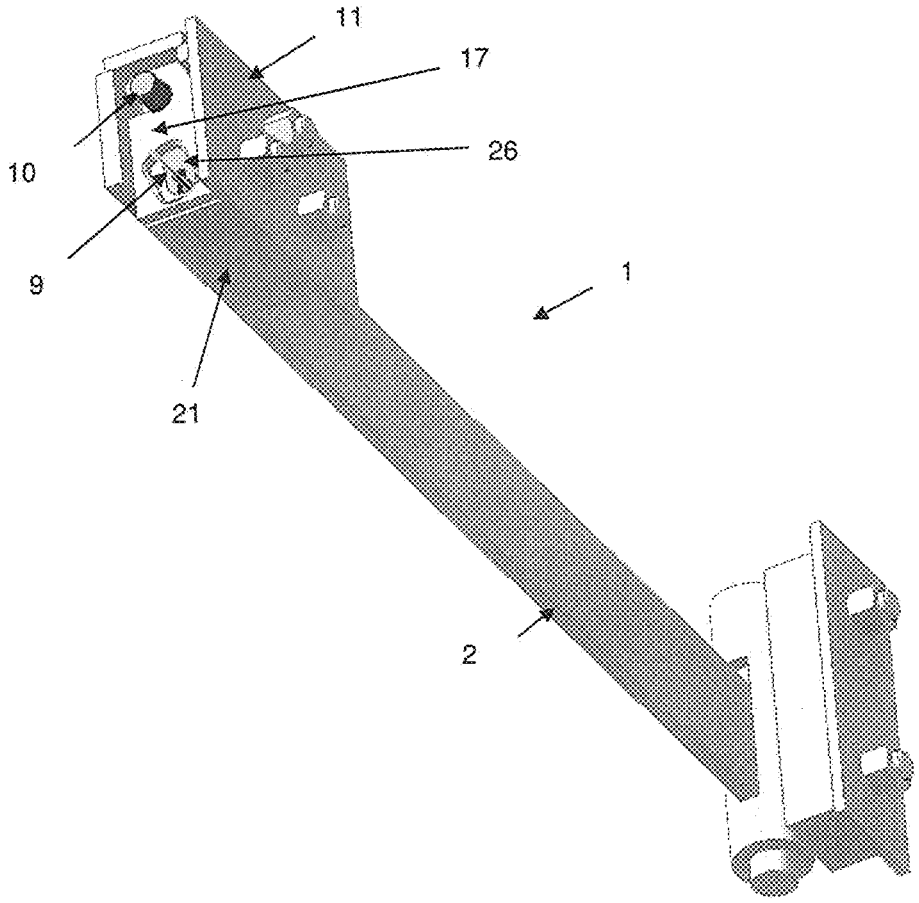
FIG. 4 shows the same locking system as FIGS. 1, 2 and 3 but shown from a fourth perspective.

FIG. 4 shows the locking system 1 from a perspective which illustrates that the fitting 11 contains a cover plate 21 that protects the lock from below.

Figure 5:
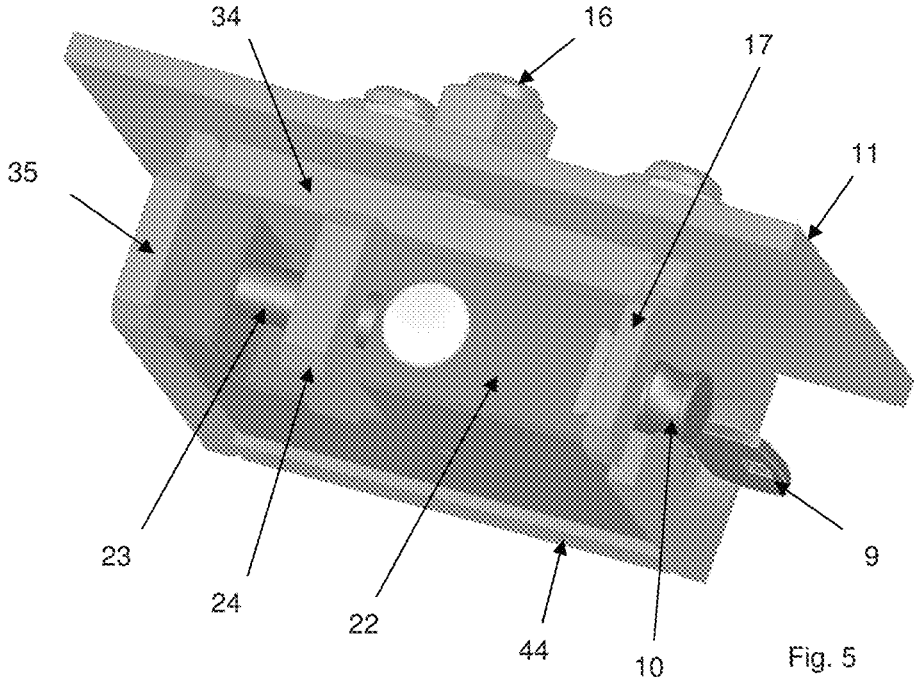
FIG. 5 shows a section of the locking system, which includes lock and lock fittings.

FIG. 5 shows the fitting 11 with the inserted lock 22.

As shown by FIG. 5, the lock 22 is enclosed on four sides by cover plates 17, 44, 35, 34.

When the bar 2 is fixed to the fitting 11 that encloses the four sides of the lock 22, the last two sides are covered by the bar 2, and the angled lock cover 12.

When the angled lock cover 12 is engaged in the fitting 11, the angled lock cover 12 will, in addition to covering the lock 22, also have the function of preventing rotation of the bar 2, as the outermost part of the lock cover 12 grips the lock 22 in an angle, which for example can be seen in FIG. 2. FIG. 5 also shows that the fitting 11 includes a lock plate 24 that contains a hole through which the lock's 22 locking pawl 23 can be introduced.

Figure 6:
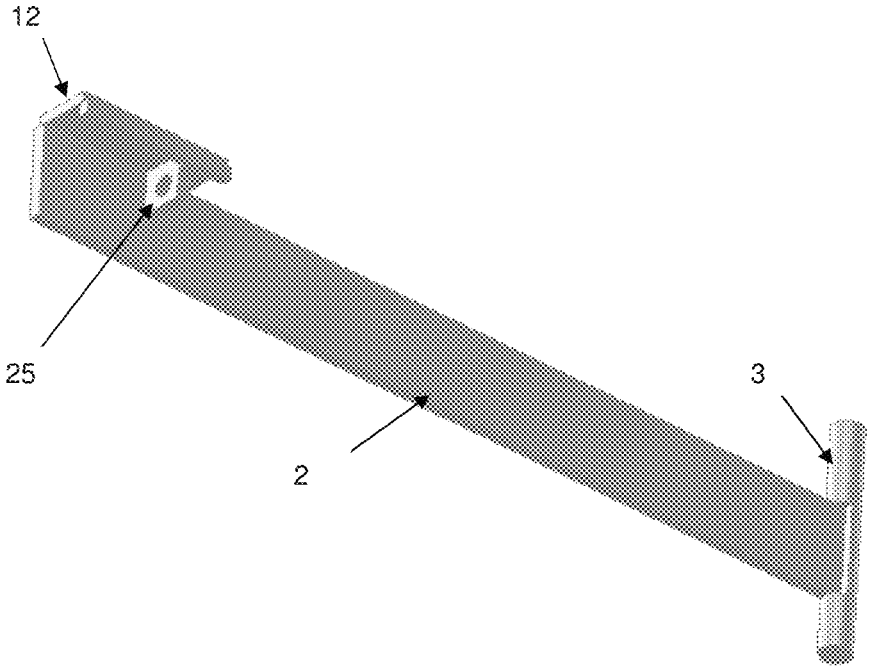
FIG. 6 shows bar for locking system, which at one end is fitted with a cylindrical shaft shown in a perspective, visualizing the bar's lock cover and lock plate.

FIG. 6 shows the bar 2 in a perspective which illustrates that the bar's 2 angled lock cover 12 includes a lock plate 25, which also contains a hole through which the lock's 22 locking pawl 23 can be introduced when the lock cover is placed over the fitting 11.

The lock plate 25 will then be located next to the lock plate 24 in a direction facing away from the key 9 as shown in FIG. 5.

Figure 7:
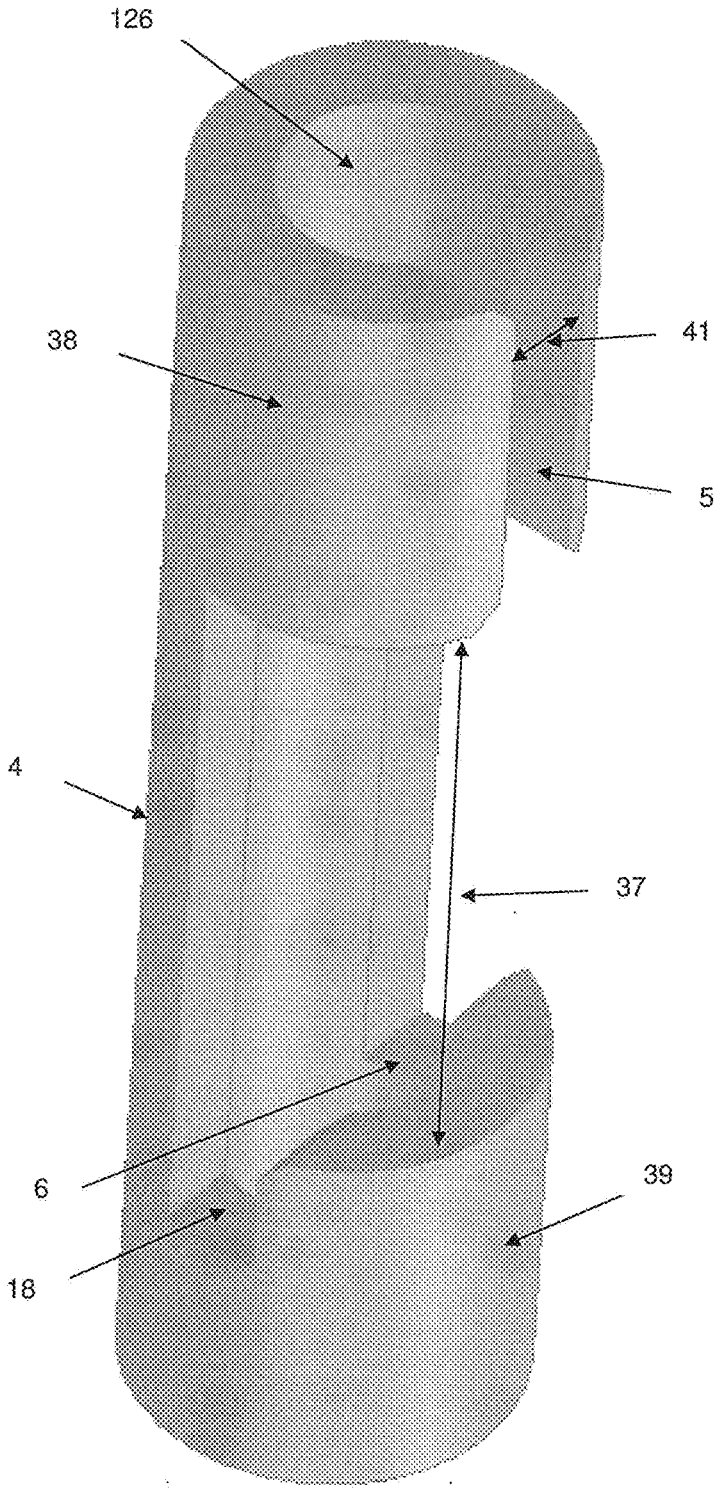
FIG. 7 shows a section of the fitting, which can partially enclose the bar's cylindrical shaft.

FIG. 7 shows the fitting component 4 which contains a primarily cylindrical hole 126 of a diameter that is slightly larger than the diameter of the bar's 2 cylindrical shaft 3, which can thus be placed in the hole 126.

The fitting component 4 contains a base 39 and an top 38, between which there is a clearance 37 that is larger than the width 43 of the bar 2, whereby the bar 2 can be rotated vertically in the fitting component 4 around the cylindrical shaft 3.

FIG. 7 also shows that the opening 5 in the top 38 has a width 41 that is greater than the thickness 40 of the bar 2, whereby the bar 2 can be removed from the fitting component 4 through the opening 5.

FIG. 7 also clearly shows the two opposed notches 6, 18, which can be used to block the bar 2 in the closed position and the 180 degrees open horizontal position, respectively.

Figure 8:
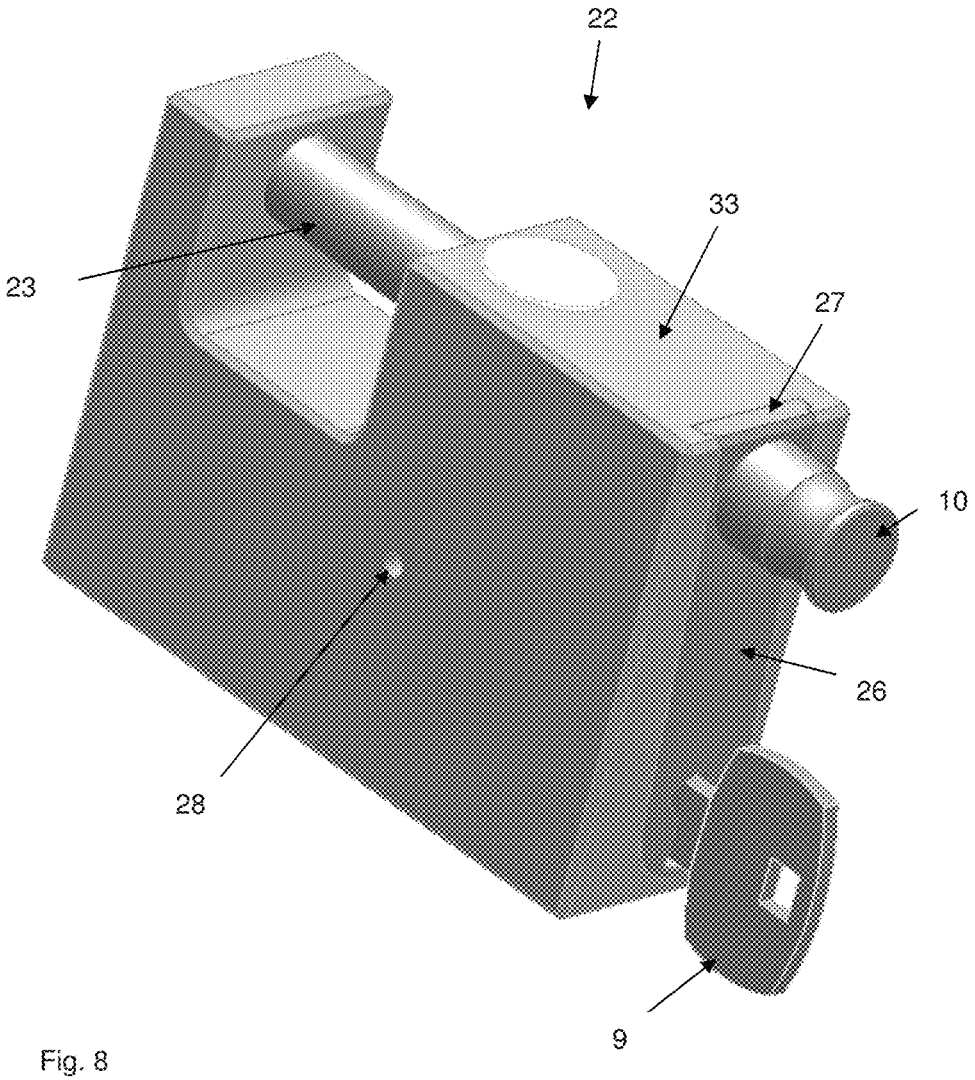
FIG. 8 shows lock for the locking system.

FIG. 8 shows the lock 22 in a perspective which illustrates that the lock 22 in the terminal surface from which the key 9 and the end 10 of the locking pawl 23 protrude, contains a cover plate 26 which is part of the lock 22 (see also FIG. 4 where a small part of the plate 26 near the key 9 is visible behind the plate 17 which is part of the fitting 11), much like the other cover plates, can be made of an appropriately hardened steel material.

At the top, the cover plate 26 can be fitted with so-called dovetails, which fasten the cover plate 26 to the headlock 33.

The lock 22 also contains a hole 28 that can be used for fixing the mounting fitting and which can also be used for supplying lubricant.

Fig. shows 9 a preferred embodiment of the locking pawl 23, which has a locking pawl end 10 in connection to which the locking pawl 23 contains an ergonomically appropriate finger grip 29.

The locking pawl 23 is also manufactured with a breakpoint 30 where the locking pawl 23 will break if the locking pawl 23 is attacked with tools from the outside.

The breakpoint 30 ensures that the locking pawl 23 is still active even if the locking pawl breaks or becomes divided in the breakpoint 30.

Furthermore, the locking pawl 23 contains a track 31 such as a groove, which can be used to secure the locking pawl 23 in a suitable position.

Figure 9:
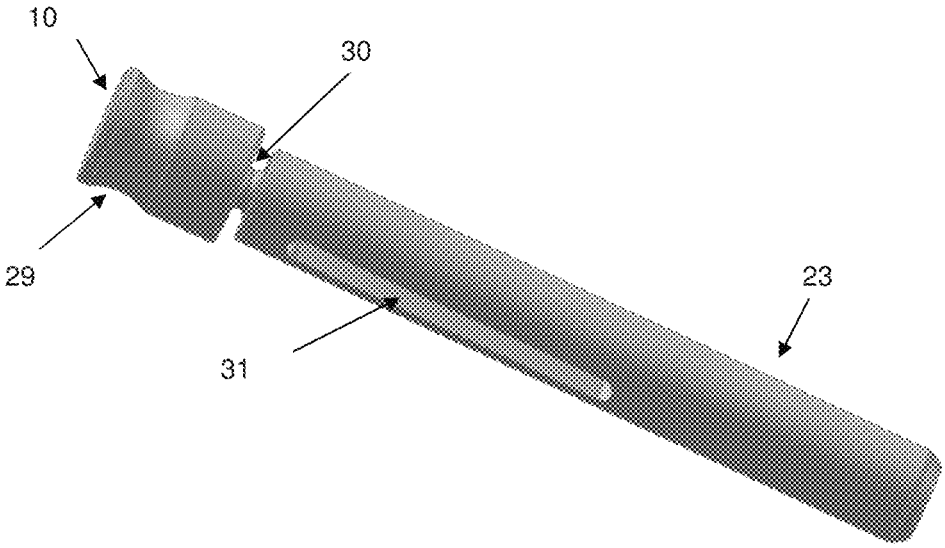
FIG. 9 shows the locking pawl for the locking system.
Figure 10:
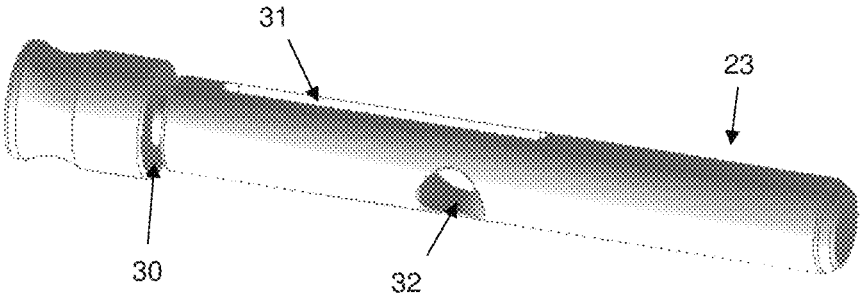
FIG. 10 shows, just as FIG. 9, locking pawl for lock for locking system, depicted from a different perspective.

FIG. 10 shows the locking pawl 23 in a different perspective than FIG. 9, which shows that the locking pawl 23 is also designed with a hole 32 for engagement with a retaining rod.

Figure 11:
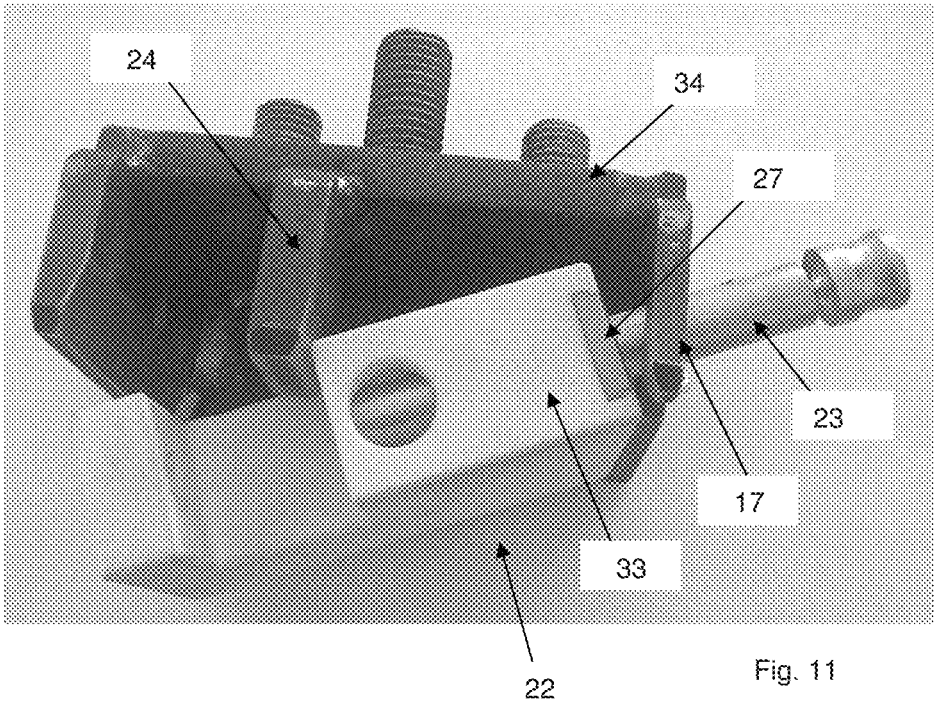
FIG. 11 shows lock, which is partly removed from lock fittings.

FIG. 11 shows the fitting 11 with a partially removed lock 22.

Figure 12:
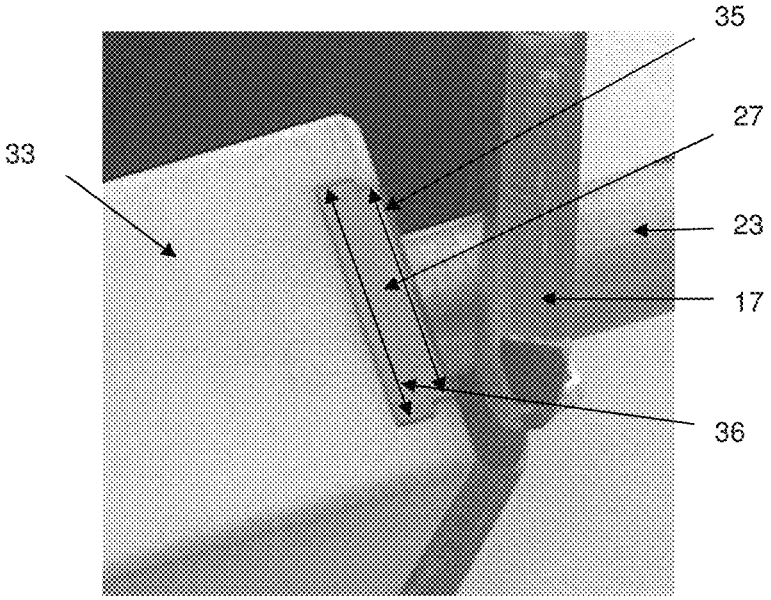
FIG. 12 shows a section of lock depicted in FIG. 11.

A section of FIG. 11 is shown in FIG. 12 wherein it is apparent that the top of the cover plate 27 contains dovetails, as the external width 35 is narrower than the smaller external width 36 of the top of the cover plate 27 whereby the cover plate is secured to the headlock 33.

The key 9 shown in for example FIG. 1 and FIG. 5 can be removed when the bar 2 is locked to the fitting 11.

In a preferred embodiment, the locking system is wholly or partly made of a suitably hardened steel material.

It can also be desirable to design the length 42 of the bar 2 such that it can be rotated 180 degrees horizontally away from the locked position with coupling to the fitting 11 without the bar 2 protruding outside the container width.

The invention claimed is:

1. A locking system for locking of compartments, boxes or containers to which the access mainly consists of double doors or a first gate and a second gate, comprising:

a bar having one end fitted with a primarily cylindrical shaft, and an opposite end fitted with an angled lock cover;

a fitting component that is adapted to be fitted in the first gate, and which partially enclose the cylindrical shaft enabling the bar to be rotated horizontally; and a fitting that is adapted to be fitted in the second gate, and which covers a lock on four sides onto which the angled lock cover is adapted to be locked, wherein the fitting component comprises a top, a base and a primarily cylindrical hole, the center axis of which after being fitted to the first gate, is primarily vertical, running between the top and the base, and wherein there is an opening between the top and the base in which the bar can rotate horizontally away when the lock cover is unlocked from the fitting fitted to the second gate, and wherein the top comprises an opening having a width that is larger than a thickness of the bar, and two opposed notches in the base, both of which can lock the rotation of the bar.

2. A locking system for locking of compartments, boxes or containers to which the access mainly consists of double doors or a first gate and a second gate, comprising:

a bar having one end fitted with a primarily cylindrical shaft, and an opposite end fitted with an angled lock cover;

a fitting component that is adapted to be fitted in the first gate, and which partially enclose the cylindrical shaft enabling the bar to be rotated horizontally; and a fitting that is adapted to be fitted in the second gate, and which covers a lock on four sides onto which the angled lock cover is adapted to be locked, wherein the fitting is configured to cover the lock with a plurality of cover plates, wherein a first cover plate contains notches for an end of a locking pawl of the lock and a locking key of the lock, and wherein the locking pawl, upon being locked, engages with a positioned lock plate of the fitting.

3. A locking system for locking of compartments, boxes or containers to which the access mainly consists of double doors or a first gate and a second gate, comprising:

a bar having one end fitted with a primarily cylindrical shaft, and an opposite end fitted with an angled lock cover;

a fitting component that is adapted to be fitted in the first gate, and which partially enclose the cylindrical shaft enabling the bar to be rotated horizontally; and a fitting that is adapted to be fitted in the second gate, and which covers a lock on four sides onto which the angled lock cover is adapted to be locked, wherein the lock of the locking system comprises a locking pawl which at one end contains a finger grip and a breakout point, and wherein the lock comprises a headlock and a cover plate containing notches for passage of the locking pawl and a key, and wherein the cover plate is secured to the headlock with dovetails.

4. A locking system for locking of compartments, boxes or containers to which the access mainly consists of double doors or a first gate and a second gate, comprising:

a bar having one end fitted with a primarily cylindrical shaft, and an opposite end fitted with an angled lock cover;

a fitting component that is adapted to be fitted in the first gate, and which partially enclose the cylindrical shaft enabling the bar to be rotated horizontally; and a fitting that is adapted to be fitted in the second gate, and which covers a lock on four sides onto which the angled lock cover is adapted to be locked, wherein the lock of the locking system comprises a locking pawl which at one end contains a finger grip and a breakout point, and wherein the lock being able to be fixed to the fitting using one or more bolts.

* * * * *